US008367599B2

(12) United States Patent
Pfeiffer et al.

(10) Patent No.: US 8,367,599 B2
(45) **Date of Patent: *Feb. 5, 2013**

(54) DISHWASHING COMPOSITION WITH PARTICLES

(75) Inventors: Natasha Pfeiffer, Stamford, CT (US); Naresh Dhirajlal Ghatlia, Southbury, CT (US); Isaac Israel Secemski, Teaneck, NJ (US)

(73) Assignee: Unilever Home & Personal Care USA, Division of Conopco, Inc., Greenwich, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/688,333

(22) Filed: Jan. 15, 2010

(65) Prior Publication Data

US 2010/0120650 A1 May 13, 2010

Related U.S. Application Data

(63) Continuation of application No. 10/266,364, filed on Oct. 8, 2002, now Pat. No. 7,674,761, which is a continuation of application No. 09/809,942, filed on Mar. 16, 2001, now Pat. No. 6,492,312.

(51) Int. Cl.

| | |
|---|---|
| ***C11D 7/22*** | (2006.01) |
| ***C11D 7/42*** | (2006.01) |
| ***C11D 7/54*** | (2006.01) |
| ***C11D 17/08*** | (2006.01) |

(52) U.S. Cl. ..... 510/439; 510/223; 510/226; 510/229; 510/370; 510/392; 510/393; 510/477

(58) Field of Classification Search ..... 510/223, 510/226, 229, 370, 372, 392, 393, 439, 477
See application file for complete search history.

(56) References Cited

U.S. PATENT DOCUMENTS

| | | | | |
|---|---|---|---|---|
| 1,077,835 | A | | 11/1913 | Kelly |
| 1,494,950 | A | | 5/1924 | Clark |
| 2,257,823 | A | | 10/1941 | Stokes |
| 2,381,091 | A | | 8/1945 | Weisman |
| 3,011,950 | A | | 5/1959 | Mehaffey |
| 3,218,776 | A | | 11/1965 | Cloud |
| 3,289,386 | A | | 12/1966 | Farmer |
| 3,353,325 | A | | 11/1967 | Jensen et al. |
| 3,585,982 | A | | 6/1971 | Hollinshead |
| 3,597,899 | A | | 8/1971 | Hanson |
| 3,892,905 | A | | 7/1975 | Albert |
| 3,958,394 | A | | 5/1976 | Mahaffy et al. |
| 3,990,872 | A | | 11/1976 | Cullen |
| 4,014,432 | A | | 3/1977 | Clothier et al. |
| 4,057,047 | A | | 11/1977 | Gossett |
| 4,115,292 | A | | 9/1978 | Richardson et al. |
| 4,115,293 | A | | 9/1978 | Schoenholz et al. |
| 4,188,304 | A | | 2/1980 | Clarke et al. |
| 4,223,029 | A | | 9/1980 | Mahler et al. |
| 4,410,441 | A | | 10/1983 | Davies et al. |
| 4,416,791 | A | | 11/1983 | Haq |
| 4,562,717 | A | | 1/1986 | Shimizu et al. |
| 4,610,799 | A | | 9/1986 | Wilsberg et al. |
| 4,728,455 | A | | 3/1988 | Rerek |
| 4,765,916 | A | | 8/1988 | Ogar, Jr. et al. |
| 4,776,455 | A | | 10/1988 | Anderson et al. |
| 4,795,032 | A | | 1/1989 | Kandathil |
| 4,806,261 | A | | 2/1989 | Ciallella et al. |
| 4,820,435 | A | | 4/1989 | Zafiroglu |
| 4,839,076 | A | | 6/1989 | Willman et al. |
| 4,846,992 | A | | 7/1989 | Fonsay |
| 4,915,267 | A | | 4/1990 | Buecheler et al. |
| 4,929,367 | A | | 5/1990 | Thomas et al. |
| 4,969,927 | A | | 11/1990 | Schumann et al. |
| 4,972,017 | A | | 11/1990 | Smith et al. |
| 4,973,416 | A | * | 11/1990 | Kennedy ..... 510/296 |
| RE33,646 | E | | 7/1991 | Klemm et al. |
| 5,114,606 | A | | 5/1992 | van Vliet et al. |
| 5,132,036 | A | | 7/1992 | Falou et al. |
| 5,141,664 | A | | 8/1992 | Corring et al. |
| 5,141,795 | A | | 8/1992 | Kai et al. |
| 5,153,161 | A | | 10/1992 | Kerschner et al. |
| 5,194,416 | A | | 3/1993 | Jureller et al. |
| 5,198,198 | A | | 3/1993 | Gladfelter et al. |
| 5,200,236 | A | | 4/1993 | Lang et al. |
| 5,224,601 | A | | 7/1993 | Gouge et al. |
| 5,227,084 | A | | 7/1993 | Martens et al. |
| 5,227,177 | A | | 7/1993 | Reil et al. |
| 5,230,822 | A | | 7/1993 | Kamel et al. |
| 5,232,622 | A | | 8/1993 | Jones et al. |
| 5,234,615 | A | | 8/1993 | Gladfelter et al. |
| 5,244,594 | A | | 9/1993 | Favre et al. |
| 5,246,612 | A | | 9/1993 | Van Dijk et al. |
| 5,246,621 | A | | 9/1993 | Favre et al. |
| 5,256,779 | A | | 10/1993 | Kerschner et al. |

(Continued)

FOREIGN PATENT DOCUMENTS

| | | | |
|---|---|---|---|
| BE | 1011118 | | 5/1999 |
| CA | 1112534 | * | 11/1981 |

(Continued)

OTHER PUBLICATIONS

Rigby, E., "At last a biodegradable wrapping", Finance Times, No. 34, 406, 21 2000, p. 17—abstract.
Mohan, A.M., "Water-soluble pouch dissolves chemical handling risks", Packag. Dig., vol. 37, No. 10, 2000, pp. 102, 104, 106, 108—abstract.
Anon, "Water soluble film finding applications", Plast. Rubber Wkly, No. 1825, 2000, p. 7—abstract.
Anon, "Label removal", Dtsch. Milchwirtsch., vol. 50, No. 22, 1999, pp. 975-976—abstract.
Anon, "Bag filling and sealing update", CHP Packer Int., vol. 6, No. 4, 1999, pp. 32, 34-35—abstract.
Safa et al., "Sorption-desorption of aromas on multi-use PET bottles, A test procedure", Packag. Technol. Sci., vol. 12, No. 1, 1999, pp. 37-44—abstract.

(Continued)

*Primary Examiner* — Gregory DelCotto
(74) *Attorney, Agent, or Firm* — Edward A. Squillante, Jr.

(57) ABSTRACT

This invention is directed to a water soluble sachet comprising a detergent composition having a discrete particle that enhances cleaning in a dishwashing machine. The water soluble sachet unexpectedly results in excellent cleaning properties and minimizes spot and film formation on items being cleaned in a dishwasher.

15 Claims, No Drawings

U.S. PATENT DOCUMENTS

| | | | | |
|---|---|---|---|---|
| 5,274,147 | A | 12/1993 | Kerschner et al. | |
| 5,280,117 | A | 1/1994 | Kerschner et al. | |
| 5,294,361 | A | 3/1994 | Van den Brom | |
| 5,336,430 | A | 8/1994 | Bahary et al. | |
| 5,384,364 | A | 1/1995 | Besse et al. | |
| 5,394,603 | A | 3/1995 | Reil et al. | |
| 5,460,743 | A | 10/1995 | Delwel et al. | |
| 5,527,483 | A | 6/1996 | Kenkare et al. | |
| 5,559,261 | A | 9/1996 | Sivik | |
| 5,589,267 | A | 12/1996 | Delwel et al. | |
| 5,613,601 | A | 3/1997 | Boulanger et al. | |
| 5,902,046 | A | 5/1999 | Shibata | |
| 5,939,373 | A | 8/1999 | Haeggberg et al. | |
| 5,996,845 | A | 12/1999 | Chan | |
| 6,040,286 | A | 3/2000 | Huff | |
| 6,085,942 | A | 7/2000 | Redmond | |
| 6,228,825 | B1 * | 5/2001 | Gorlin et al. | 510/226 |
| 6,281,183 | B1 * | 8/2001 | Harbour | 510/406 |
| D451,795 | S | 12/2001 | Ghatlia et al. | |
| D452,143 | S | 12/2001 | Ghatlia et al. | |
| 6,475,977 | B1 | 11/2002 | Pfeiffer et al. | |
| 6,492,312 | B1 * | 12/2002 | Pfeiffer et al. | 510/221 |
| D472,799 | S | 4/2003 | Ghatlia et al. | |
| D479,123 | S | 9/2003 | Ghatlia et al. | |
| 6,632,785 | B2 | 10/2003 | Pfeiffer et al. | |
| D487,563 | S | 3/2004 | Ghatlia et al. | |
| 6,727,215 | B2 | 4/2004 | Roberts et al. | |
| 7,674,761 | B2 * | 3/2010 | Pfeiffer et al. | 510/439 |
| 2002/0010123 | A1 * | 1/2002 | Schmiedel et al. | 510/446 |
| 2002/0094942 | A1 | 7/2002 | Danneels et al. | |
| 2003/0017955 | A1 | 1/2003 | Forth et al. | |

FOREIGN PATENT DOCUMENTS

| | | | | |
|---|---|---|---|---|
| DE | 1287502 | | | 1/1969 |
| DE | 9303456 | | | 6/1993 |
| DE | 19521140 | | | 12/1996 |
| DE | 19521140 | A1 | | 12/1996 |
| DE | 29612148 | | | 1/1998 |
| DE | 29801621 | | | 3/1998 |
| DE | 19727073 | | | 1/1999 |
| DE | 19727073 | A1 | | 1/1999 |
| EP | 079712 | A1 | | 5/1983 |
| EP | 0157612 | A2 | | 10/1985 |
| EP | 0158464 | A1 | | 10/1985 |
| EP | 160254 | | | 11/1985 |
| EP | 0160254 | A2 | | 11/1985 |
| EP | 0170386 | A2 | | 2/1986 |
| EP | 266199 | A2 | | 5/1988 |
| EP | 266583 | | | 5/1988 |
| EP | 0266583 | A2 | | 5/1988 |
| EP | 0337568 | A2 | | 10/1989 |
| EP | 343069 | | | 11/1989 |
| EP | 0343069 | A1 | | 11/1989 |
| EP | 343070 | | | 11/1989 |
| EP | 0343070 | A1 | | 11/1989 |
| EP | 347221 | A1 | | 12/1989 |
| EP | 0366231 | A1 | | 5/1990 |
| EP | 373395 | | | 6/1990 |
| EP | 0373395 | A2 | | 6/1990 |
| EP | 0388105 | A2 | | 9/1990 |
| EP | 414463 | A2 | | 2/1991 |
| EP | 479404 | A2 | | 4/1992 |
| EP | 593952 | A1 | | 10/1992 |
| EP | 0518689 | A1 | | 12/1992 |
| EP | 0291198 | B1 | | 11/1993 |
| EP | 593952 | | | 4/1994 |
| EP | 596550 | A2 | | 5/1994 |
| EP | 608910 | A1 | | 8/1994 |
| EP | 700989 | A1 | | 3/1996 |
| EP | 718199 | A1 | | 6/1996 |
| EP | 748673 | A2 | | 12/1996 |
| EP | 846757 | A2 | | 6/1998 |
| EP | 893491 | A1 | | 1/1999 |
| EP | 909809 | A2 | | 4/1999 |
| EP | 0909809 | A2 | | 4/1999 |
| EP | 941939 | A1 | | 9/1999 |
| EP | 1314653 | A1 | | 5/2003 |
| FR | 2601930 | A | | 1/1988 |
| FR | 2666349 | A | | 3/1992 |
| FR | 2675734 | A | | 10/1992 |
| FR | 2684594 | A | | 6/1993 |
| FR | 2724388 | A | | 3/1995 |
| FR | 2724388 | A | | 3/1996 |
| GB | 989350 | | | 4/1965 |
| GB | 2028446 | A | | 3/1980 |
| GB | 2060544 | A | | 5/1981 |
| GB | 2085440 | A | | 4/1982 |
| GB | EP2085442 | A | | 4/1982 |
| GB | 2118961 | A | | 11/1983 |
| GB | 2187748 | A | | 9/1987 |
| GB | 2221158 | A | | 1/1990 |
| GB | 2257388 | A | | 1/1993 |
| GB | 2259883 | A | | 3/1993 |
| GB | 2305931 | A | | 4/1997 |
| JP | 9087105 | | | 3/1997 |
| WO | WO8904282 | | | 5/1989 |
| WO | WO9422800 | | | 10/1994 |
| WO | WO9523099 | | | 8/1995 |
| WO | WO9618713 | | | 6/1996 |
| WO | WO9623859 | | | 8/1996 |
| WO | WO9623860 | | | 8/1996 |
| WO | WO9623861 | | | 8/1996 |
| WO | WO9629189 | | | 9/1996 |
| WO | WO9700282 | | | 1/1997 |
| WO | WO9727743 | | | 8/1997 |
| WO | WO9830670 | | | 7/1998 |
| WO | WO9958633 | | | 11/1999 |
| WO | WO0002980 | | | 1/2000 |
| WO | WO0006688 | | | 2/2000 |
| WO | WO00/55415 | | * | 9/2000 |
| WO | WO0055068 | | | 9/2000 |
| WO | WO0055415 | | | 9/2000 |
| WO | WO01/60966 | | * | 8/2001 |
| WO | WO0160966 | | | 8/2001 |
| WO | WO01/85898 | | * | 11/2001 |
| WO | WO0183669 | | | 11/2001 |
| WO | WO02/08370 | | * | 1/2002 |
| WO | WO02/08371 | | * | 1/2002 |
| WO | WO0208380 | | | 1/2002 |
| WO | WO0240351 | | | 5/2002 |
| WO | WO0240370 | A1 | | 5/2002 |
| WO | WO02057402 | A1 | | 7/2002 |
| WO | WO02060980 | A2 | | 8/2002 |
| WO | WO02074891 | A2 | | 9/2002 |
| WO | WO02074892 | A1 | | 9/2002 |
| WO | WO02094974 | A1 | | 11/2002 |
| WO | WO03008287 | A1 | | 1/2003 |
| WO | WO03008486 | A2 | | 1/2003 |
| WO | WO2006023859 | A1 | | 3/2006 |

OTHER PUBLICATIONS

Anon, "Sachets introduced for laundry", Manuf. Chem., vol. 69, No. 12, 1998, p. 9—abstract.

Anon, "The butcher and baker choice", Labels Labelling, vol. 19, No. 6, 1997, p. 28(P)—abstract.

Anon, "Label keg closure", Verpack, Berat., No. 11, 1997, pp. 21-22—abstract.

Valishina et al., "Water soluble glues for food industry packaging", Package Package Mag., No. 2, 1998, p. 32—abstract.

Anon, "Chance products find international market", Print. Ind. Bull., vol. 19, No. 1, 1996, p. 4—abstract.

Anon, Labels rinse off, Austropack, No. 10, 996, pp. 10-11(P)—abstract.

Anon, "Mr. Coffee adopts starch-based sheets and planks cushioning", Good Packag. Mag., vol. 57, No. 7, 1996, p. 19—abstract.

Anon, "Combinations water-soluble package (38534)", Res. Disclosure, No. 285, 1996, p. 307—abstract.

Ayshford, H., "The industry flexes its muscles", Packag. Week, vol. 11, No. 42, 1996, p. 27—abstract.

Anon, "Detergent Packaging in water soluble films", Disposable Nonwovens, vol. 25, No. 3, 1996, p. 2—abstract.

Zimmerman, W., "Synthesis and applications of water soluble polymers", Adhasion, vol. 40, No. 5, 1996, pp. 22-25 (K, P)—abstract.

Barton et al., "2nd European Recycling Workshop, Brussels, Belgium, Jun. 29-30, 1994", EUR 16155, Luxembourg: Office for Official Publications of the European Communities, 1995 320pp (ISBN 92-826-9617-0)(628.477)(11347)—abstract.
Anon, "New Medical product Line will Dissolve Once Washed", Nonwovens Mark., vol. 9, No. 2, 1994, p. 8—abstract.
Saporta, H., "Hydrosoluble Packaging", Emballage dig., No. 384, 1994, pp. 10-11—abstract.
Taillefer, M., "Difficult to be Envoronmentally Firendly, Extensive Emissions Continue from the Graphics Industry", Aktuell Grafisk Inf., No. 234, 1993, pp. 52-53—abstract.
Rooney et al., "Alternatives Available for Voc Control", Package Print. Converting, vol. 40, No. 5, 1993, pp. 48-50—abstract.
Anon, "Water-Soluble Plastic—A Recycling Revolution?", Neue Verpack, vol. 44, No. 12, 1991, pp. 36, 39—abstract.
Anon, "Linpac Plastics in Take-Over Moves", Plast. Rubber Wkly., No. 1416, 1991, p. 4—abstract.
Anon, "Loose-Fill an Environmentalist Can Love", Packag. Dig., vol. 28, No. 4, 1991, pp. 44, 46—abstract.
Griffin, S., "PVOH—A Film for a changing Environment", Paper presented at Rapra Technology Ltd. and Pira INnernational, "Is Plastics Packaging Rubbish?" held Jan. 30-31, 1991 at Birmingham, UK, 3pp, [Leatherhead, UK; Pira INternational, 1991, Price on appilcaiotn, Pira staff only, )PK 9009JC)(8464)]—abstract.
Anon, "Nor Hand Labeller at Ridley", Bre. Guardian, vol. 119, No. 12, 1990, p. 31—abstract.
Heathcote, J., "An Environmentally Acceptable solution", Plast, rubber Wkly, No. 1293, 1989. pp. 10-11—abstract.
Carr, P., "Water soluble packaging—The Modern Alternative for Farmers", Packaging (U.K), vol. 59, No. 677, 1988, pp. 4-5, 23—abstract.
Anon, "Sticks fast and advertises: Self-adhesive labels from Jackstadt", Neue Verpack, vol. 36, No. 6, 1983, pp. 760, 762-763—abstract.
Aoyama, T., "Rigilon and Miraclon-Water-Soluble Photosensitive Resin Plates", Gr. Arts Jpn, vol. 22, 1980-81, pp. 83-89—abstract.
Anon, "No discharge necessary: a trouble shooting film: the package which disappears", Pack Rep., No. 12, 1980, pp. 10, 11, 14, 16—abstract.
Kay, D.A., "Water resistant polymer coatings for water soluble glass packaging contianers. Progress reort No. 4 design and evaluaiton of a water disposable glass packaging container", Clemson Univ., SC, Div. of Interdisciplinary Studies Master's thesis May 1971, 81pp (available from NTIS as PB-256 931/7Ga price: HC 5 00 dol MF 3 00 dol); Govt Rept Announc vol. 76, No. 23, 1976, p. 127—abstract.
"Tape Packaging, Paper (for Carton Sealing)", PPP-T-76C, Washington: US General Services Administration May 1976 6 pp (US Fed Spec PPP-T-76C/SD 986)—abstract.
Craver et al., "Applied Polymer Science", Washington: ACS, Divsn Organic Coatings and Plastics Chemistry 1975 921 pp (2360/BK 778)—abstract.
"The Disappearing Pack", Packag. Rev., vol. 97, No. 1, 1977, p. 29—abstract.
Marcilia et al., "Some Enicronmental Aspects of PVC", Revista de Plasticos Modemos; 80, No. 529, 2000, p. 56-62—abstract.
Hodgkinson et al., "Processible PVOH Joins the Thermoplastic Party", Materials World; 8, No. 4, 2000, p. 24-5—abstract.
Pidgeon, R., "Reports Finding Could boost Laundry Bag Sales", Packaging Magazine; 3, No. 4, 2000, p. 6—abstract.
"Depart PVOH Film Goes Commercial", British Plastics and Rubber; 1999, p. 13—abstract.
"Water Soluble Pouches from Chris Craft", converter, 35, No. 6, 1998, p. 8—abstract.
"75 Years of Adhesives from henkel", Adhasion Kleben & Dichten; 42, No. 3, 1998, pp. 10-11—abstract.
Chris-Craft, "Product Informaiton. Mono-Sol M-8630 Water Soluble Film", Gary, In., 1998, pp. 2.28 cms Jun. 12, 2000—abstract.
Ahmed, S.U., "New Adhesives for Temporary Bonding and Fabric Kamination", TAPPI 1997 Hot Melt Symposium. conference Proceedings; Hilton Head, SC, 1997, pp. 127-129, 6A1—abstract.
"Water-Soluble Film Makes Tough Packaging Material for Chemicals", Food, Cosmetics & Drug Packaging; 20, No. 5, 1997, p. 91—abstract.
Calato, F., "Packaging Changes Course" Materie Plastiche ed Elastomeri; No. 5, 1997, p. 308-13—abstract.
"Detergents Packaged More Sagely", European Plastics News; 23, No. 8, 1996, p. 69—abstract.
Renfree et al., "Development of a Standard Protocol to Produce PEPT Flake for the Evaluation of Possible Discolouration Resulting from Labels", antec 96, vol. III, conference proceedings; Indianapolis, 1996, pp. 3126-3130—abstract.
Allen et al., "Multilayer Barrier Film for Ostomy Applications"—abstract, (1994).
Fauvarque, J., "Ethylene Oxide; Moving Towards Optimum INtergration", Informations Chimie; No. 363, 1994, pp. 123-134—abstract.
"Polyethers for Films", Modern Plastics Internaitonal; 23, No. 5 1993, p. 70—abstract.
McCarthy-Bates, L., "Biodegradables Blossom into Field of Freams for Packagers", Plastics World; 51, No. 3, 1993, pp. 22/27—abstract.
"Japan Chemical Firms Seeking Ways to Cope with Changing Situation (Part 3)", Japan Chemical Week; 33, No. 1675, 1992, pp. 6-7—abstract.
"Paper Holds Key to Water Soluble Polymer Market", High Performance Plastics; 1991, pp. 8-9—abstract.
Green et al., "Novel Water Soluble Copolymerisable Benzophenone Photoinitiators", Polymers Paint Colour Journal, 180, No. 4253, 1990, pp. 42/46—abstract.
Fernandi, M.J., "Degradable Plastics an Overview", Recyclingplas IV; Plastics Recycling as a Future Business Opportunity Conference Proceedings; 1989, pp. 215-237 8(13)—abstract.
"Stuck with It", Packaging Week, 4 No. 15, 1988, pp. 18/22—abstract.
"Soluble Packaging", Health & Safety at Work; 10, No. 3, 1988, p. 44—abstract.
Moroi, H., "New Production Technologies and Applicaitons of Polyvinyl Alcohol", British Polymer Journal; 20, No. 4, 1988, pp. 335-343—abstract.
"Water Soluble Film Agreement", European Plastics News; 14, No. 12, 1987, p. 27—abstract.
"Water Soluble Films Agreement", Packaging Week, 3, No. 25, 1987, p. 7—abstract.
"Belland process Produces Plastics Which Can Dissolve to Order", Plastics and Rubber Weekly; No. 1179, 1987, p. 27—abstract.
Dyeber, G., "Water Removable Pressure-Sensitive Adhesives", European Adhesives & Sealants; 2, No. 2, 1985, pp. 12-13—abstract.
BP Chemicals Belgium SA, "Breox Polyethylene Glycols", Data Sheet PRGDS 1 London, 1980, p. 60—abstract.
Blecher et al., "Polyvinylpyrrolidone", Reprint (Handbook of Water-soluble gums and Resins, McGraw-Hill, Inc. 1980, chapter 21, p. 18—abstract.
U.S. Military (Corporate Author), "L-B-1283, Bag. Soiled Clothes (Water soluble, Plastic)", Philadelphia, PA 1977, NALOAN—abstract, (1996).
Ex Parte Reexamination for Pfeiffer et al., U.S. Appl. No. 10/264,996, filed Oct. 4, 2002.
Ex Parte Reexamination for Pfeiffer et al., U.S. Appl. No. 09/810,106, filed Mar. 16, 2001.
Order Granting Requiest for Ex Parte Reexamination dated Jun. 8, 2004, U.S. Appl. No. 90/006,992.
Order Grnating Request for Ex Parte Reexamination dated Jun. 8, 2004, U.S. Appl. No. 90/006,994.
PCT Annex on PCT Application No. PCT/EP02/02770 mailed Aug. 7, 2002.
Journal of Applied Polymer Science, vol. 90, pp. 2420-2427 (2003), Kumeta et al., Crosslinking Reaction of Poly(vinyl alcohol) with Poly(acrylic acid (PAA) by Heat Treatment: Effect of Neutralization of PAA (Mar. 2003).
Die angewandte Makromolekulare Chemie, 240, (1996), pp. 213-219, Hirai et al., Ph-Induced Structure Change of Poly(vinyl alcohol) Hydrogel Crosslinked with Poly(Acrylic Acid).
e-Polymers 2004, No. 078, Zeng et al., electrospun poly(vinyl alcohol)/poly(acrylic acid) fibres with excellent water-stability (Dec. 2004).

* cited by examiner

DISHWASHING COMPOSITION WITH PARTICLES

This application is a continuation application of U.S. Ser. No. 10/266,364 (filed Oct. 8, 2002) now U.S. Pat. No. 7,674,761 and entitled, Water Soluble Sachet with a Dishwashing Enhancing Particle and which is a continuation of U.S. Ser. No. 09/809,942 (filed Mar. 16, 2001), now U.S. Pat. No. 6,492,312.

FIELD OF THE INVENTION

This invention is directed to a composition for use in a dishwashing machine. More particularly, the invention is directed to a water soluble sachet comprising such a dishwashing composition along with a discrete particle that enhances cleaning in a dishwashing machine. The dishwashing composition preferably is a gel that comprises an anti-spotting agent and at least one of a water soluble polymer that reduces phosphate scale formation and a compound that reduces carbonate scale formation. The sachet unexpectedly results in excellent cleaning properties and excellent glass appearance without leaving a detergent residue, which is typically characteristic of dishwashing compositions in tablet or powder form.

BACKGROUND OF THE INVENTION

Dishwashing compositions constitute a generally recognized distinct class of detergent compositions, particularly when compared to detergents designed for fabric washing. For example, the ultimate dishwashing composition results in a spotless and film-free appearance on glassware and silverware after a cleaning cycle in a dishwashing machine. In fabric washing operations, on the other hand, detergent compositions which result in greasy, oily or soapy residues on items that were cleaned can be tolerated.

Often, washing articles in a commercially available dishwashing machine entails using three products. Salt is added to the salt compartment to recharge the ion exchanger which softens the water, a dishwashing formulation is used to clean the articles and a rinse aid is used to ensure that the articles are rinsed with no streaks or smears. Consumers generally find it very inconvenient, however, to replace or refill such products.

In order to provide convenient products to consumers, manufacturers have been making dishwashing tablets in order to eliminate detergent handling and dosing issues. Such tablets often have a detergent portion, and a wax portion which contains a rinse aid. These types of tablets, which are sometimes referred to as 2-in-1 tablets, have disadvantages since they may only be used in a wash cycle that does not exceed 55° C. This is true because the wax portion which contains the rinse aid will completely dissolve in a wash cycle that exceeds 55° C. This causes all of the rinse aid to drain out of the dishwashing machine before the actual rinse cycle. Furthermore, such 2-in-1 tablets require that salt be added to the dishwashing machine in order to obtain optimal results, and they are very complicated and expensive to produce.

Other types of tablets that are well known are often referred to as pH sensitive 2-in-1 tablets. These types of tablets have a detergent portion and rinse aid portion that is contained in a pH sensitive material, the rinse aid portion to be released under the lower pH conditions of the rinse cycle. The pH sensitive 2-in-1 tablets may be used in wash cycles that exceed 55° C., but they are known to prematurely release rinse aid in hot washes that run long. Also, like the detergent tablets with the wax portion, the pH sensitive 2-in-1 tablets require that salt be added to the dishwashing machine in order to obtain optimal cleaning results and they are extremely expensive to produce.

In addition to the above-described deficiencies of conventional tablets, such conventional tablets also are known to characteristically leave residue on dishware being cleaned because they do not always completely dissolve within a dishwashing cycle. Conventional tablets are also difficult to handle because they often require unwrapping before use. Also, those that are not wrapped can be unpleasant to handle because of fines on the surface of the tablet.

It is of increasing interest to provide a dishwashing composition that works well at all wash temperatures of a dishwashing system (even temperatures greater than 55° C.), provides anti-scaling benefits in a system that is high in phosphate and/or carbonate content (in hard water), does result in excellent cleaning benefits in water that has not been subjected to conventional water softening additives (i.e., hard water), provides a shiny glassware appearance in the absence of conventional rinse aid compositions and does not leave residue on dishware being cleaned. This invention, therefore, is directed to a dishwashing composition that is associated with an anti-spotting agent, and preferably has at least one of a water soluble polymer that reduces phosphate scale formation and a compound that reduces carbonate scale formation on glassware being cleaned. The dishwashing composition is superior in that it unexpectedly results in excellent cleaning properties and reduced spotting and scale formation, even when no salt is added to the dishwashing machine to soften hard water, when washing cycles exceed a temperature of 55° C., and when no rinse aid composition is added to the dishwashing machine. In fact, the present invention is directed to a superior 3-in-1 detergent composition that is contained in a stable water soluble sachet. Such a superior detergent composition unexpectedly results in a reduction in film and spot formation even when compared to similar compositions in solid (e.g., powder/tablet) form.

Additional Information

Efforts have been made to prepare dishwashing compositions. In U.S. Pat. No. 5,939,373, an automatic dishwashing detergent composition comprising a phosphate builder and a metal containing bleach catalyst is described.

Still other efforts have been disclosed for making dishwashing compositions. In WO 00/06688, a dishwashing composition with a coated core is described. The coated core has a substance that exerts its function in a clear rinse cycle.

Even further, other efforts have been disclosed for making dishwashing compositions. In DE 197 27 073 A1, coated detergent components are described.

None of the material above describes a dishwashing composition within a water soluble sachet wherein the dishwashing composition is in the form of a gel and comprises an anti-spotting agent. Moreover, none of the material above describes a dishwashing composition within a water soluble sachet comprising an anti-spotting agent and a water soluble polymer that reduces phosphate scale formation and/or a compound that reduces carbonate scale formation wherein the dishwashing composition results in excellent cleaning properties and glass appearance when used, for example, in the presence of hard water, in the absence of rinse aid compositions and in a washing cycle that exceeds a temperature of 55° C.

SUMMARY OF THE INVENTION

In a first embodiment, the present invention is directed to a water soluble sachet comprising a dishwashing composition wherein the dishwashing composition is a gel which comprises discrete particles, the discrete particles having an approximate diameter from about 100 to about 5000 microns, and the discrete particles and gel being in a particle to gel weight ratio from about 0.005 to 0.4:1.

In a second embodiment, the present invention is directed to a water soluble sachet comprising a dishwashing composition having:

(a) an anti-spotting agent comprising a hydrophobically modified polycarboxylic acid, a surfactant having a cloud point in water of less than about 60° C., or both; and (b) a water soluble polymer that reduces phosphate scale formation, a compound that reduces carbonate scale formation, or both wherein the dishwashing composition is a gel.

In a third embodiment, the present invention is directed to a method for minimizing spotting and phosphate and/or carbonate scale formation on glassware being cleaned, comprising the steps of:

(a) inserting a water soluble sachet into a dishwashing machine;

(b) allowing the water soluble sachet to dissolve; and (c) subjecting the glassware to a dishwashing composition comprising the above-described anti-spotting agent, and a water soluble polymer that reduces phosphate scale formation, a compound that reduces carbonate scale formation, or both.

In a fourth embodiment, the present invention is directed to a package comprising the dishwashing composition described in the first aspect of this invention and instructions not to use a rinse aid composition or conventional water softening salts or both.

As used herein, glassware is defined to include drinking glasses, and any other articles typically found in a commercial or domestic dishwasher. Also, as used herein, water soluble sachet is defined to mean a sachet made of a material that will dissolve, for example, in a cleaning cycle of a domestic dishwasher. Gel, as used herein, is defined to mean any liquid having a viscosity of greater than about 100 cps and less than about 45,000 cps, measured at a shear rate of 1/s at ambient temperature. Approximate diameter is defined to mean the estimated diameter of a discrete particle that is not a perfect sphere. Hydrophobically modified polycarboxylic acid is defined to mean a compound, oligomer or polymer having at least one carboxylic acid group and at least one group that is not water soluble.

DETAILED DESCRIPTION OF THE PREFERRED EMBODIMENTS

The materials that may be used to make the water soluble sachets of this invention include those which may generally be classified as water soluble resins, such as film-forming water soluble resins, either organic or inorganic.

Suitable water-soluble resins which may be used in the invention are described in Davidson and Sittig, *Water-Soluble Resins*, Van Nostrand Reinhold Company, New York (1968), herein incorporated by reference. The water-soluble resin should have proper characteristics such as strength and pliability in order to permit machine handling. Preferred water-soluble resins include polyvinyl alcohol, cellulose ethers, polyethylene oxide, starch, polyvinylpyrrolidone, polyacrylamide, polyvinyl methyl ether-maleic anhydride, polymaleic anhydride, styrene maleic anhydride, hydroxyethylcellulose, methylcellulose, polyethylene glycols, carboxymethylcellulose, polyacrylic acid salts, alginates, acrylamide copolymers, guar gum, casein, ethylene-maleic anhydride resin series, polyethyleneimine, ethyl hydroxyethylcellulose, ethyl methylcellulose, hydroxyethyl methylcellulose. Lower molecular weight water-soluble, polyvinyl alcohol film-forming resins are generally, preferred.

The generally preferred water-soluble, polyvinyl alcohol film-forming resins should, in addition to low weight average molecular weights, have low levels of hydrolysis in water. Polyvinyl alcohols preferred for use herein have a weight average molecular weight between about 1,000 and about 300,000, and preferably, between about 2,000 and about 150,000, and most preferably, between about 3,000 and about 100,000, including all ranges subsumed therein.

Even further, it is within the scope of this invention to include polyvinyl alcohol films which are copolymers such as films prepared from vinyl acetate and methacrylic acid precursor monomers. Preferred copolymers typically comprise less than about 15.0% by weight methacrylic acid units in their backbone.

When compared to plastics, the tensile strength of polyvinyl alcohol is relatively high, and when compared with other water-soluble materials, the tensile strength of polyvinyl alcohol is extremely high. Reasonable tensile strength is required in film used in sachets of the present invention in order to permit proper handling and machining of the articles. The tensile strength of polyvinyl alcohol will vary with a number of factors, including the percent hydrolysis, degree of polymerization, plasticizer content, and humidity. In a most preferred embodiment, polyvinyl alcohol is used to make the water soluble sachet of this invention and the dishwashing composition contained therein is substantially free of an unencapsulated compound containing boron, whereby substantially free is defined to mean less than about 2.0% by weight of boron containing compound, based on total weight of the dishwashing composition within the water soluble sachet.

Polyvinylpyrrolidone, another preferred resin for use to make the sachets of the present invention, may be made from a variety of solvents to produce films which are clear, glossy, and reasonably hard at low humidities. Unmodified films of polyvinylpyrrolidone may be hygroscopic in character. Tackiness at higher humidities may be minimized by incorporating compatible, water-insensitive modifiers into the polyvinylpyrrolidone film, such as 10% of an aryl-sulfonamide-formaldehyde resin.

Other preferred water-soluble films may also be prepared from polyethylene oxide resins by standard calendering, molding, casting, extrusion and other conventional techniques. The polyethylene oxide films may be clear or opaque, and are inherently flexible, tough, and resistant to most oils and greases. These polyethylene oxide resin films provide better solubility than other water soluble plastics without sacrificing strength or toughness. The excellent ability to lay flat, stiffness, and sealability of water-soluble polyethylene oxide films make for good machine handling characteristics.

The weight percent of water-soluble, film-forming resin in the final articles of the present invention is from about 0.1% to about 10%, preferably about 0.25% to about 7.5%, and most preferably about 0.50% to about 5%, including all ranges subsumed therein.

As to the dishwashing composition that may be used in this invention, such a composition is a gel having a viscosity from about 100 to about 45,000 cps, and preferably, from about 200 to about 30,000 cps, and most preferably, from about 300 to about 25,000 cps, at ambient temperature, including all ranges subsumed therein. The components of the dishwashing composition of this invention are limited only to the extent that they may be combined to make a gel having the above-described viscosities and that they do not degrade the structural properties of the film sachet forming materials to an extent where the dishwashing properties of the dishwashing composition are compromised. Typically, such components include water, thickening agent, bleach, buffering agent and builder. Water typically makes up the balance. The dishwashing composition within the water soluble sachet of the present invention can comprise optional ingredients which include colorants, bleach scavengers, perfumes, lime soap dispersants, inert organic molecules, enzymes (liquid or solid), enzyme-stabilizers, builders, surfactants, non-encapsulated bleach, anti-foam, anti-tarnish and anti-corrosion agents.

In a preferred embodiment the dishwashing composition used in this invention comprises:

a) an anti-spotting agent comprising a hydrophobically modified polycarboxylic acid, a surfactant having a cloud point in water of less than about 60° C., or both; and b) a water soluble polymer that reduces phosphate scale formation, a compound that reduces carbonate scale formation, or both wherein the dishwashing composition is a gel.

There generally is no limitation with respect to the type of hydrophobically modified polycarboxylic acid that may be used in this invention other than that the polycarboxylic acid can be used in a dishwashing composition that comprises a water soluble polymer. Such a hydrophobically modified polycarboxylic acid often has a weight average molecular weight of greater than about 175 and less than about 1.5 million, and preferably, greater than about 200 and less than about 1 million; and most preferably, greater than about 225 and less than about 750 thousand, including all ranges subsumed therein.

The preferred hydrophobically modified polycarboxylic acid which may be used in this invention comprises at least one structural unit of the formula:

(I)

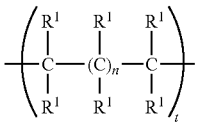

, and (II)

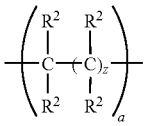

wherein each $R^1$ and $R^2$ are independently a hydrogen, hydroxy, alkoxy, carboxylic acid group, carboxylic acid salt, ester group, amide group, aryl, $C_{1-20}$ alkyl, $C_{2-20}$ alkenyl, $C_{2-20}$ alkynyl or a polyoxyalkylene condensate of an aliphatic group, n is an integer from about 0 to 8, z is an integer from about 1 to about 8, t is an integer from about 0 to about 2,000 and a is an integer from about 0 to about 2,000, with the proviso that a and t are not simultaneously 0 and at least one $R^1$ or one $R^2$ is a carboxylic acid group, or a salt thereof.

In a preferred embodiment, the hydrophobically modified polycarboxylic acid used in this invention comprises at least one structural unit represented by formula I (t-1) with at least one $R^1$ as a carboxylic acid group (or salt thereof), and at least one structural unit represented by formula II (a-1) with at least one $R^2$ group as a $C_{4-20}$ alkyl group or a $C_{8-30}$ ethoxylated condensate of an aliphatic group.

In a most preferred embodiment, however, the modified polycarboxylic acid used in this invention comprises structural units represented by formula I and structural units represented by formula II wherein a is from about 80% to about 120% of t, and at least two $R^1$ groups are carboxylic acid groups (or salts thereof) and at least one $R^2$ group is a methyl group and at least one $R^2$ group is a $C_5$ alkyl, and n is 0 and z is 1.

The hydrophobically modified polycarboxylic acids which may be used in this invention are typically prepared by reacting the desired precursors ($sp^2$ bonded monomers) under free radical polymerization conditions. Such polycarboxcylic acids are also commercially available from suppliers like Rohm & Haas and DuPont. A more detailed description of the types of hydrophobically modified polycarboxylic acids which may be used in this invention, including the process for making the same, may be found in U.S. Pat. No. 5,232,622, the disclosure of which is incorporated herein by reference.

The preferred and most preferred hydrophobically modified polycarboxylic acids are made available by Rohm & Haas under the names Acusol 820 and 460, respectively.

There is generally no limitation with respect to how much hydrophobically modified polycarboxylic acid that may be used in this invention other than the amount used results in a dishwashing composition. Typically, however, from about 0.1 to about 10.0, and preferably, from about 0.2 to about 7.0, and most preferably, from about 0.3 to about 5.0% by weight of the dishwashing composition is a hydrophobically modified polycarboxylic acid, based on total weight of the dishwashing composition, including all ranges subsumed therein.

The surfactant having a cloud point in water of less than about 60° C. typically enhances wetting properties of the glassware being cleaned. These nonionic surfactants can be broadly defined as surface active compounds with at least one uncharged hydrophilic substituent. A major class of nonionic surfactants are those compounds produced by the condensation of alkylene oxide groups with an organic hydrophobic material which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative examples of various suitable nonionic surfactant types are polyoxyalkylene condensates of aliphatic carboxylic acids, whether linear- or branched-chain and unsaturated or saturated, especially ethoxylated and/or propoxylated aliphatic acids containing from about 8 to about 18 carbon atoms in the aliphatic chain and incorporating from about 2 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid.

Other nonionic surfactants having a cloud point of less than about 60° C. include polyoxyalkylene condensates of aliphatic alcohols, whether linear- or branched-chain and unsaturated or saturated, especially ethoxylated and/or propoxylated aliphatic alcohols containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol. Preferred examples of such materials are provided by BASF Corporation as a series under the tradename Plurafac. Particularly preferred surfactants are Plurafac LF 301, Plurafac LF 403 and Plurafac SLF-18. Also included within this class of nonionic surfactants are epoxy capped poly(oxyalkylated) alcohols as described in WO 94/22800. A preferred example of this class of material is poly-tergent SLF 18B 45 made available by BASF Corporation.

Polyoxyethylene or polyoxypropylene condensates of alkyl phenols, whether linear- or branched-chain and unsaturated or saturated, containing from about 6 to 12 carbon atoms and incorporating from about 2 to about 25 moles of ethylene oxide and/or propylene oxide are other types of nonionic surfactants which may be used.

Other desired nonionic surfactants which may be used include polyoxyethylene-polyoxypropylene block copolymers having formulae represented as $$HO(CH_2CH_2O)_a(CH(CH_3)CH_2O)_b(CH_2CH_2O)_cH$$

or $$HO(CH(CH_3)CH_2O)_d(CH_2CH_2O)_e(CH(CH_3)CH_2O)_fH$$

wherein a, b, c, d, e and f are integers from 1 to 350 reflecting the respective polyethylene oxide and polypropylene oxide blocks of said polymer. The polyoxyethylene components of the block polymer constitutes at least about 10% of the block polymer. The material preferably has a molecular weight of between about 1,000 and 15,000, more preferably from about 1,500 to about 6,000.

These materials are well known in the art. They are available as a series of products under the trademark "Pluronic" and "Pluronic R", from the BASF Corporation.

It is also noted herein that while the anti-spotting agents used in this invention typically have a cloud point of less than about 60° C., they preferably have a cloud point of less than about 50° C., and most preferably, less than about 45° C.

The surfactants having a cloud point in water of less than about 60° C. are typically present within the dishwashing composition at levels of at least 0.5 wt. %, preferably, 1-15 wt. %, and most preferably, 1.5 to 8 wt. %, based on the total weight of the dishwashing composition, including all range subsumed therein.

As to the water soluble polymer that reduces phosphate scale formation, such a polymer often comprises at least one structural unit derived from a monomer having the formula:

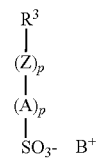

(III)

wherein $R^3$ is a group comprising at least one $sp^2$ bond, z is O, N, P, S, or an amido or ester link, A is a mono- or a polycyclic aromatic group or an aliphatic group and each p is independently 0 or 1 and $B^+$ is a monovalent cation.

Preferably, $R^3$ is a $C_2$ to $C_6$ alkene (most preferably ethene or propene). When $R^3$ is ethenyl, Z is preferably amido, A is preferably a divalent butyl group, each t is 1, and $B^+$ is $Na^+$. Such a monomer is polymerized and sold as Acumer 3100 by Rohm & Haas.

Another preferred embodiment exists when the water soluble polymer is derived from at least one monomer with $R^3$ as 2-methyl-2-propenyl, Z as oxygen, A as phenylene, each t as 1 and $B^+$ as $Na^+$, and at least one monomer with $R^3$ as 2-methyl-2-propenyl, each t as 0 and $B^+$ as $Na^+$. Such monomers are polymerized and sold under the name Alcosperse 240 by Alco Chemical.

It is further noted herein that it is within the scope of this invention for all the polymers used to be a homopolymer or copolymer, including terpolymers. Furthermore, the polymers of this invention may be terminated with conventional termination groups resulting from precursor monomers and/or initiators that are used.

There is generally no limitation with respect to how much water soluble polymer that reduces phosphate scale formation is used in this invention as long as the amount used results in a dishwashing composition. Often, from about 0.5 to about 10.0, and preferably, from about 1.0 to 7.0, and most preferably, from about 1.5 to about 4.5% by weight water soluble polymer is used, based on total weight of the dishwashing composition, including all ranges subsumed therein. These water soluble polymers typically have a weight average molecular weight from about 1,000 to about 50,000.

Regarding the compounds that may be used to reduce carbonate scale formation, these include polyacrylates (and copolymers thereof) having a weight average molecular weight from about 1,000 to about 400,000. Such compounds are supplied by Rohm and Haas, BASF, and Alco Corp. Preferred copolymers include those derived from acrylic acid and maleic acid monomers like Sokalan CP5 and CP7 supplied by BASF, and Acusol 479N, supplied by Rohm & Haas. Copolymers of acrylic acid and methacrylic acid (Colloid 226/35), as supplied by Rhone-Poulenc, may also be used.

Other materials that may be used to reduce carbonate scale formation include phosphonate functionalized acrylic acid (Casi 773 as supplied by Buckman laboratories); copolymers of maleic acid and vinyl acetate, and terpolymers of maleic acid, acrylic acid and vinyl acetate (made commercially by Huts); polymaleates (like Belclene 200, as supplied by FMC); polymethacrylates, (like Tomal 850, as supplied by Rohm & Haas); polyaspartates; ethylene diamine disuccinate, organopolyphosphonic acids (and salts thereof) such as sodium salts of amino tri(methylenephosphonic acid), diethylene triamine penta (methylene phosphonic acid); hexamethylene diamine tetramethylene phosphonic acid; ethane 1-hydroxy-1,1-diphosphonic acid (HEDP); organomonophosphonic acids (and salts thereof) such as the sodium salt of 2-phosphono-1,2,4-butane tricarboxylic acid, all of which are sold under the Dequest line as supplied by Solutia. Phosphates, especially alkali metal tripolyphosphates may also be used as well as mixtures of the above-described materials. It has also been found that combinations of anti-scaling agents can be more effective at reducing calcium carbonate scale than individual anti-scaling agents themselves.

The materials that may be used to reduce carbonate scale formation typically make up from about 0.01% to about 10.0%, and preferably, from about 0.1% to about 6.0%, and most preferably, from about 0.2% to about 5.0% by weight of the total weight of dishwashing composition, including all ranges subsumed therein.

Any conventional dishwashing builders may be used in this invention. Non-phosphate containing builders such as alkali metal salts of polycarboxylic acids may be sued (e.g., sodium citrate, iminodisuccinate, oxydisuccinate). Phosphate containing builders are a preferred builder in this invention. Such builders typically make up from about 5.0 to about 75.0% by weight of the total weight of the dishwashing composition, including all ranges subsumed therein. Preferably, however, the amount of phosphate containing builder employed is from about 10.0 to about 70.0, and most preferably, from about 15.0 to about 65.0% by weight based on total weight of the dishwashing composition and including all ranges subsumed therein. The phosphate containing builders which may be used in this invention are well known, for example, for binding metals such as Ca and Mg ions, both of which are often abundant in hard water found in dishwashing machines. An illustrative list of the phosphate builders which may be used in this invention include sodium, potassium and ammonium pyrophosphate; alkali metal tripolyphosphates, sodium and potassium orthophosphate and sodium polymetaphosphate, with potassium tripolyphosphate (KTP) being especially preferred.

As to the discrete particles that enhance cleaning in a dishwashing machine, such particles, again, have an approximate diameter from about 100 to about 5,000 microns, and preferably, from about 200 to about 4,500 microns, and most preferably, from about 300 to about 3,500 microns, including all ranges subsumed therein.

When the discrete particle is an encapsulated bleach which may be used in this invention, such a bleach (i.e., the core of the encapsulated bleach) includes organic and inorganic peracids as well as salts thereof. Illustrative examples include epsilon phthalimido perhexanoic acid (PAP) and Oxone®, respectively. The bleaches may be employed with bleach activators, and collectively, the bleach and the activator make up from about 0.02 wt. % to about 20.0 wt. % of the total weight of the dishwashing composition.

The clad (i.e., outer shell) of the discrete particle which is an encapsulated bleach is typically a wax such as a paraffin wax. Such paraffin waxes have low melting points, i.e., between about 40° C. and about 50° C. and a solids content of from about 35 to 100% at 40° C. and a solids content of from 0 to about 15% at 50° C. This melting point range for the clad material is desirable for several reasons. The minimum of 40° C. generally exceeds any typical storage temperatures that are encountered by cleaning compositions. Thus, the wax coat will protect the core throughout storage of the cleaning composition. The 50° C. melting point cap for the wax clad was selected as providing a wax which will quickly melt or soften early in any automatic dishwashing wash cycle. Melting or softening sufficient to release the core will occur because operating temperatures in automatic dishwashers are usually between 40° C. and 70° C. Thus, the paraffin waxes of the invention will release the core material when the capsule is exposed to the warmed wash bath, but not before. Paraffin waxes are selected over natural waxes for the subject invention because in liquid alkaline environments, natural waxes hydrolyze and are unstable. Moreover, melted paraffin waxes of the encapsulated bleaches used in the invention will remain substantially molten at 40°-50° C. Such molten wax is easily emulsified by surfactant elements in cleaning compositions. Consequently, such waxes will leave less undesirable waxy residue on items to be cleaned than waxes with higher melting points.

Thus, the wax coat preferably does not include any paraffins having a melting point substantially above 50° C., lest the higher melting point components remain solid throughout the wash cycle and form unsightly residues on surfaces to be cleaned nor any paraffins with solid contents discussed below.

The distribution of solids of the paraffin waxes of the invention ensures storage integrity of the encapsulated particles at temperatures up to 40° C. in either a liquid or moist environment while yielding good melting performance to release its active core during use at temperatures of about 50° C.

The amount of solids in a wax at any given temperature as well as the melting point range may be determined by measuring the latent heat of fusion of each wax by using Differential Scanning Calorimetry (DSC) by a process described in Miller, W. J. et al. Journal of American Oil Chemists' Society, July, 1969, V. 46, No. 7, pages 341-343, incorporated by reference. This procedure was modified as discussed below. DSC equipment used in the procedure is preferably the Perkin Elmer Thermoanalysis System 7 or the Dupont Instruments DSC 2910.

Specifically, the DSC is utilized to measure the total latent heat of fusion of multi-component systems which do not have a distinct melting point, but rather, melt over a temperature range. At an intermediate temperature within this range one is capable of determining the fraction of the latent heat required to reach that temperature. When acquired for a multi-component mixture of similar components such as commercial waxes, this fraction correlates directly to the liquid fraction of the mixture at that temperature. The solids fraction for the waxes of interest are then measured at 40° C. and 50° C. by running a DSC trace from −10° C. to 70° C. and measuring the fraction of the total latent heat of fusion required to reach these temperatures. A very low temperature ramping rate of 1° C./min should be used in the test to ensure that no shifting of the graph occurs due to temperature gradients within the sample.

The more solids present in a wax at room temperature, the more suitable the wax is for the present invention; this is because such solids strengthen the wax coating, rendering the particle less vulnerable to ambient moisture or a liquid aqueous environment, whereas "oil" or liquid wax softens the wax, opening up pores in the coating and thereby provides poorer protection for the core of the particle. Significant solid paraffin remaining at 50° C. may remain on the cleaned hard surfaces (e.g., dishware in an automatic dishwashing machine) and is undesirable.

Therefore, the wax solids content as measured by Differential Scanning Calorimetry for suitable paraffin waxes may range from 100 to about 35%, optimally from 100 to about 70%, at 40° C. and from 0 to about 15% and preferably 0 to about 5% at 50° C.

Particles coated with micro-crystalline waxes would therefore have a poorer protective coating, and the wax coat which melts from such particles wold be less likely to emulsify in cleaning compositions. Thus, micro-crystalline wax are not considered within the operative scope of this invention.

Commercially available paraffin waxes which are suitable for encapsulating the solid core materials include Merck 7150 (54% solids content at 40° C. and 2% solids content at 50° C.) ex. E. Merck of Darmstadt, Germany; IGI 1397 (74% solids content at 40° C. and 0% solids content at 50° C.) and IGI 1538 (79% solids content at 40° C. and 0.1% solids content at 50° C. ex. The International Group, Inc. of Wayne, Pa.; and Ross fully refined paraffin wax 115/120 (36% solids content at 40° C. and 0% solids content at 50° C.) ex Frank D. Ross Co., Inc. of Jersey City, N.J. Most preferred is IGI 1397.

Mixtures of paraffin waxes with other organic materials such as polyvinyl ethers as described in U.S. Pat. Nos. 5,460,743 and 5,589,267 are also useful to make the clods of this invention.

Other bleaches which may be used within the discrete particles (encapsulated bleaches) in this invention include hydrogen peroxide and its precursors (e.g., sodium perborate and sodium percarbonate), alkyl, aryl and acyl peroxides such as benzoyl peroxide and solid chlorine bleach sources such as dichloroisocyanurate.

When preparing the discrete particles which are encapsulated bleaches, such an encapsulated particle is made via well known art recognized techniques which include spraying molten wax onto bleach particles in a fluidized bed. A preferred process is described in U.S. Pat. No. 5,230,822. An encapsulated bleach (in the form of a discrete particle) is preferred in this invention since the clad prevents interactions between the bleach and film forming resin during storage of the sachets.

If desired, conventional bleach activators (including catalysts) may be used with the bleaches described herein. These activators include (6-nonamidocaproxyl) oxybenzene sulfonate (as described in EPO 170,386) N,N,N',N'-tetraacetylethylenediamine, nonanoyloxybenzenesulfonate, cationic nitriles, cholyl(4-sulfophenyl)carbonate, and quaternary imine salts (e.g., N-methyl-3,4-dihydrooisoquinolinium p-toluenesulfonate).

Other bleach activators which may be used include transition metal-containing bleach catalysts such as $[Mn^{IV}_2(\mu\text{-}0)_3(Me_3TACN)_2](PF_6)_2$ (as described in U.S. Pat. Nos. 4,728,455, 5,114,606, 5,153,161, 5,194,416, 5,227,084, 5,244,594, 5,246,612, 5,246,621, 5,256,779, 5,274,147, 5,280,117), $[Fe^{II}(MeN4py)(MeCN)](ClO_4)_2$ (as described in EP 0 909 809) and $[Co^{III}(NH_3)_5(OAc)](OAc)_2$ (as described in U.S. Pat. No. 5,559,261, WO 96/23859, WO 96/23860, WO 96/23861). It is further noted that the bleach activators employable in this invention may be added to the dishwashing composition as granulates or encapsulated granulates or both.

It is also within the scope of this invention to employ (optionally) discrete particles which are dishwashing enzymes. The discrete particles which are enzymes typically make up from about 0.5 to about 10.0% by weight of the total weight of the dishwashing composition and include proteases like Savinase®, Purafect Ox®, Properase®, and Ovozyme® and amylases like Termamyl®, Purastar ST®, Purastar Ox Am®, and Duramyl®, all of which are commercially available.

Other discrete particles which may be used in this invention include those comprising an antifoaming agent. These discrete particles may comprise essentially any known antifoam compound, including, for example, silicone antifoams, silicone oil, mono- and distearyl acid phosphates, mineral oil, and 2-alkyl and alcanol antifoam compounds. These antifoaming agents may be used in combination with defoaming surfactants. The dishwashing composition typically comprises from about 0.02 to 2% by weight of antifoaming agent in the form of a discrete particle, preferably, 0.05 to 1.0%.

Other discrete particles which may be used in the water soluble sachets of this invention include anti-tarnishing agents. Such anti-tarnishing agents typically comprise benzotriazole, 1,3 N-azoles, isocyanuric acid, purine compounds, and mixtures thereof.

The buffering agents which may be used typically make up from about 1.0 to about 25.0% by weight of the total weight of the dishwashing composition and include well known buffering agents like potassium and sodium salts of disilicate, bicarbonate and carbonate. Conventional dishwashing surfactants may also (optionally) be employed in this invention and these include anionic surfactants like alkyl sulfates and sulfonates as well as fatty acid ester sulfonates. Particularly, salts of (i.e., sodium, potassium, ammonium, and substituted ammonium salts such as mono-, di- and triethanolamine salts) anionic sulfates, sulfonates, carboxylates, and sarcosinates may be used. Other optional anionic surfactants which may be used include isothionates, like acyl-isothionates, N-acyltaurates, fatty acid amides of methyl tauride, alkyl succinates and sulfocsuccinates; mono esters of sulfosuccinate; and diesters of sulfosuccinate. These types of surfactants often make up from about 0.0% to about 10.0% by weight of the total weight of the dishwashing composition.

When preparing the dishwashing composition of this invention, the desired components (e.g., anti-spotting agent and water soluble polymer) or solutions thereof are mixed, and added to a solution of the thickening agent. The order of addition of ingredients can be varied. The amount of water present in the detergent composition is typically from about 15% to about 80%, and preferably from about 20% to about 75% and most preferably from about 25% to about 70% by weight, based on total weight of the detergent composition, including all ranges subsumed therein. The thickeners which may be used in this invention include cross-linked anionic polymers. Illustrative examples include cross-linked polyacrylic acid-type thickening agents which are sold by B.F. Goodrich under their Carbopol trademark. Especially preferred are Carbopol 934, 940, 941, 980 and 981.

The amount of the high molecular weight, cross-linked polyacrylic acid or other high molecular weight, hydrophilic cross-linked polyacrylic acid-type thickening agent to impart the desired rheological property of linear viscoelasticity will generally be in the range of from about 0.1 to 3.0%, and preferably, from about 0.2 to 2.0% by weight based on the weight of the composition. It is also noted that thickening agents that are not bleach resistant may also be employed with the sachets of the present invention.

Other optional additives which may be used with the preferred embodiments of this invention include well known items such as perfumes, dispersants, colorants, lime soap dispersants, inert organic molecules, enzyme stabilizers, non-encapsulated bleaches and bleach scavengers. Such additives, collectively, do not normally make up more than about 8.0% by weight of the total weight of the dishwashing composition.

When washing glassware with the dishwashing composition of this invention, soiled glassware is typically placed in a conventional domestic or commercial dishwashing machine as is the dishwashing composition of this invention (in no particular order). The dishwashing composition of this invention then dissolves in the water (as does the sachet comprising it) of the dishwasher to wash the glassware. The typical dishwashing cycle is from about 10 minutes until about 60 minutes and the typical temperature of the water in the dishwasher is from about 40° C. to about 70° C. The glassware resulting from the above-described cleaning method is clean and has an excellent glass appearance (i.e., substantially free of film and spots). Such results are unexpectedly obtained even when hard water at high temperatures (greater than 55° C.) is used, in the absence of rinse aid compositions.

When marketing the superior dishwashing composition having the discrete particle of this invention, it is preferred that the dishwashing composition is a gel, as described above, and sold in a package with directions to add the dishwashing composition to the dishwashing machine as a 3-in-1 product. Thus, a dishwasher is charged with the dishwashing composition of this invention without having to add to the dishwasher conventional rinse aid compositions and sodium chloride.

When preparing the actual water soluble sachets of the present invention, any of the art recognized techniques for making water soluble sachets may be used.

One particularly preferred method for pressing the actual water soluble sachets of the present invention employ thermoformed packages. The thermoforming process generally involves molding a first sheet of water soluble film to form one or more recesses adapted to retain the gel of the current invention, placing the gel in at least one recess, placing a second sheet of water soluble material over the first so as to cover each recess, and heat sealing the first and second sheets together at least around the recesses so as to form one or more water soluble packages, as described in WO 00/55415. A second route comprises vertical form-fill-seal (VFFS) envelopes. In one of the VFFS processes, a roll of water soluble film is sealed along its edges to form a tube, which tube is heat sealed intermittently along its length to form individual envelopes which are filled with gel and heat sealed.

The size and the shape of the sachet are not limited and individual sachets may be connected via perforated resin. Preferably, the sachet is of the size to carry a unit dose for a domestic dishwashing machine.

The following examples are proved to facilitate an understanding of the present inventions. The examples are not intended to limit the scope of the inventions as described in the claims.

| Examples | 1 | 2 | 3 | 4 | 5 | 6 | 7 | 8 |
|---|---|---|---|---|---|---|---|---|
| Carbopol 627 | 1.5 | | | | | | | |
| Carbopol 980 | | 1 | 0.8 | | 1.5 | 1.5 | 1.5 | |
| Carbopol 941 | | | | 1 | | | | |
| KTP | 30 | 31 | 27.4 | 29 | 30 | 28 | 30 | 40.8 |
| Potasium carbonate | | | | 8 | | | | |
| Potasium bicarbonate | | | 7.6 | | | 8 | | |
| Glycerol | 6 | 6.8 | 6 | 6 | 7.5 | 7.5 | 6 | 11.5 |
| KOH | 0.8 | 0.7 | 0.6 | | 0.6 | 0.8 | 0.8 | 1.1 |
| Sokalan CP7 | 5 | | | | | | | |
| Sokalan PA25 PN | | 3.8 | 3.4 | 3.7 | 3.7 | | 3.7 | 5.6 |
| Na EHDP | | 0.8 | 0.7 | 0.8 | 0.8 | 1.1 | 0.8 | 0.9 |
| Sodium sulfite | 0.1 | 0.2 | 0.1 | 0.1 | 0.1 | 0.1 | 0.1 | 0.1 |
| Nonionic surfactant[a] | 2 | 2.1 | 1.9 | 4.5 | 2 | 4 | 2 | 2.3 |
| Bleach (PAP capsules) | 4.3 | 4.6 | 9.2 | 4.3 | 4.3 | 4.3 | 4.3 | 4.2 |
| Amylase | 0.4 | 0.7 | 0.7 | 0.4 | 0.4 | 0.4 | 0.4 | 0.6 |
| Protease | 0.6 | 1.6 | 1.6 | 0.6 | 0.6 | 0.6 | 0.6 | 1.5 |
| Alcosperse 240 | | | | | 2 | 2 | 2 | 2.8 |
| Acusol 460 | | | | | 2 | 1 | 1 | 1 |
| SLS | | 1.4 | 1.2 | | | | 2 | 1.7 |
| Antifoam | | 1.6 | 1.5 | | | | 0.6 | 1.5 |

[a]Nonionic surfactant used was Plurafac LF 403 or Poly-Tergent SLF-18B 45.

Examples 1-8 depict examples of detergent compositions with discrete particles that included encapsulated bleaches, enzymes and anti-foams all of which was filled into the sachets in the described inventions. All sachets were made with PVA film (Chris Craft M8630).

Example 9

Cleaning experiments were carried out in Bauknecht dishwasher using the 50 BIO(N) program. Detergent, 33 grams, as described in example 3, was sealed within a sachet. The pouch was placed in the dispenser of the machine. Water used for the experiment was adjusted to 300 ppm permanent hardness with Ca:Mg=4:1 and $NaHCO_3$ adjusted to 320 ppm. Soils used included: 4 ceramic plates coated with 2.0 g egg yolk on each plate; 4 stainless steel plates coated with 2.0 g each of egg yolk; 4 ceramic plates coated with 2.0 g ea. of potato starch soil; 4 ceramic plates coated with 2.0 g ea. of cream of wheat; 4 ceramic plates coated with 2.0 g ea. of roux soil; 40 g of ASTM butter-milk soil; 6 cups with 3× tea stain. 8 clean glasses were placed onto the top rack of dishwasher. Teacups were visually assessed for residual tea stain and scored on a scale of 0-5 with a score of 0 indicating 100% clean 5 representing unwashed cups. The egg plates were visually examined for residual soil, and were then scored on a scale from 0 (no residual soil) to 100 (100% area covered with soil), while wheat and roux plates were dipped in an iodine bath to expose residual soil and scored on a 0-100 scale similar to the egg soil. The scores reported in example 10 are average scores of each type of soil.

| Example 9 | Tea | Egg-Ceramic | Egg-Steel | Wheat | Roux |
|---|---|---|---|---|---|
| Score | 2.1 | 0 | 0 | 0 | 10 |

As can be seen by example 9, the dishwashing gel composition with discrete particle for enhancing cleaning in a dishwasher enclosed in a water soluble sachet provided excellent cleaning results.

Examples 10-12

Tests to monitor the anti-spotting and anti-filming efficacy of formulations were performed in a Miele G656 machine, using a 55° C. Normal cleaning cycle. Water used for the experiment was adjusted to 300 ppm permanent hardness with Ca:Mg=4:1 and $NaHCO_3$ adjusted to 320 ppm. 40 g of buttermilk soil on the door of the dishwasher and 10 g of egg yolk were added prior to the run. A full clean dish load, with 8 glasses, was included for scoring. At the end of the run, glasses were scored for spotting. Spotting scores were recorded based on area covered by, and intensity of the spots. The scores are expressed on a 0 to 5 scale, 0 being completely free of spots. The sachets containing 33 g of formulation (made per example 1) were dosed via the dispenser and the polymer additives were dosed as either aqueous solutions (Example 11) or as solids (Example 12) at the time of cup opening.

| Example | Dose | Spots |
|---|---|---|
| 10 | 1 sachet | 1.4 |
| 11 | 1 pouch +<br>2.16 g Acusol 460(25% active) +<br>1.23 g Alcosperse 240 (44% active) | 0.8 |
| 12 | 1 pouch +<br>0.54 g Acusol 460 (solid) +<br>0.54 g Alcosperse 240-D (solid) | 2.5 |

As can be seen by a comparison of Examples 12 and 13 there is a significant performance advantage when the polymers are dosed in the liquid form rather than as dried solids.

What is claimed is:

1. A water soluble, single-compartment sachet comprising a machine dishwashing composition wherein the dishwashing composition is a gel comprising discrete particles having an approximate diameter from about 100 to about 5,000 microns and the discrete particles and gel being in a particle to gel ratio from about 0.005 to 0.15:1, the sachet suitable for use in a dishwashing machine having a washing cycle from about 10 minutes to about 60 minutes at a water temperature from about 40° C. to about 70° C. and further wherein the composition comprises from about 15 to about 80% by weight water and a thickener comprising cross-linked polyacrylic acid, the cross-linked polyacrylic acid making up from about 0.1 to about 3.0% by weight of the composition, and the water soluble sachet comprises a water soluble film-forming resin that comprises polyvinyl alcohol.

2. The water soluble sachet comprising a dishwashing composition according to claim 1 wherein the sachet can be used to clean glass and reduce film.

3. The water soluble sachet comprising a dishwashing composition according to claim 1 wherein the discrete particle is an anti-foaming agent, bleach, anti-tarnishing agent, enzyme or a mixture thereof.

4. The water soluble sachet comprising a dishwashing composition according to claim 1 wherein the sachet comprising a dishwashing composition reduces carbonate scale formation on dishware.

5. The water soluble sachet comprising a dishwashing composition according to claim 1 wherein the sachet comprising a dishwashing composition further comprises a colorant.

6. The water soluble sachet comprising a dishwashing composition according to claim 1 wherein the sachet comprising a dishwashing composition is a unit dose for a dishwashing machine.

7. The water soluble sachet comprising a dishwashing composition according to claim 1 wherein the water soluble sachet is a thermoformed package.

8. The water soluble sachet comprising a dishwashing composition according to claim 1 wherein the water soluble sachet is a vertical-form-fill-seal envelope.

9. The water soluble sachet comprising a dishwashing composition according to claim 1 wherein the sachet comprises from about 0.02 to 2% by weight anti-foaming agent and/or 1.0 to 25% by weight buffering agent.

10. The water soluble sachet according to claim 1 wherein the dishwashing composition is substantially free of unencapsulated compound containing boron.

11. The water soluble sachet according to claim 1 wherein the dishwashing composition further comprises inert organic molecules, perfume, lime soap dispersants or a mixture thereof.

12. The water soluble sachet according to claim 1 wherein the discrete particles comprise a bleach particle that has an outer shell which is a wax having a melting point between about 40° C. and about 50° C.

13. The water soluble sachet according to claim 1 wherein the discrete particles comprise dishwashing enzyme.

14. The water soluble sachet according to claim 1 wherein the discrete particles comprise an antifoaming agent.

15. The water soluble sachet according to claim 1 wherein the discrete particles comprise an anti-tarnishing agent.

* * * * *